US012005372B2

(12) United States Patent
Kærsgaard et al.

(10) Patent No.: US 12,005,372 B2
(45) Date of Patent: Jun. 11, 2024

(54) TOY CONSTRUCTION SYSTEM WITH FUNCTION CONSTRUCTION ELEMENTS

(71) Applicant: LEGO A/S, Billund (DK)

(72) Inventors: Rasmus Bissenbakker Kærsgaard, Horsens (DK); Henrik Colfach Sørensen, Egtved (DK); Erik Hansen, Randbøl (DK); Henrik Hautop Lund, Odense M (DK)

(73) Assignee: LEGO A/S, Billund (DK)

( * ) Notice: Subject to any disclaimer, the term of this patent is extended or adjusted under 35 U.S.C. 154(b) by 90 days.

(21) Appl. No.: 16/835,883

(22) Filed: Mar. 31, 2020

(65) Prior Publication Data

US 2020/0261818 A1 Aug. 20, 2020

Related U.S. Application Data

(63) Continuation of application No. 15/309,746, filed as application No. PCT/EP2015/060486 on May 12, 2015, now Pat. No. 10,625,173.

(30) Foreign Application Priority Data

May 15, 2014 (DK) ..... PA 2014 70289

(51) Int. Cl.
*A63H 33/04* (2006.01)
*A63H 33/08* (2006.01)

(52) U.S. Cl.
CPC ..... *A63H 33/042* (2013.01); *A63H 33/086* (2013.01); *A63H 2200/00* (2013.01)

(58) Field of Classification Search
CPC . A63H 33/042; A63H 33/086; A63H 2200/00
See application file for complete search history.

(56) References Cited

U.S. PATENT DOCUMENTS 3,005,282 A 10/1961 Christiansen
4,820,233 A * 4/1989 Weiner ..... A63H 5/00 446/175

(Continued)

FOREIGN PATENT DOCUMENTS

CN 101047694 A 10/2007
EP 1005055 A2 5/2000

(Continued)

OTHER PUBLICATIONS

Danish Patent and Trademark Office's Search Report, issued in priority application No. PA 2014 70289, dated Dec. 17, 2014.

(Continued)

*Primary Examiner* — Eugene L Kim
*Assistant Examiner* — Alyssa M Hylinski
(74) *Attorney, Agent, or Firm* — Day Pitney LLP; George Chaclas; Anthony A. Kassas

(57) ABSTRACT

A toy construction system comprising a plurality of function construction elements, wherein each function construction element comprises a function device adapted to perform a controllable function, and a tag construction element mechanically connectable to at least a first function construction element of the plurality of function construction elements and configured for data communication between the tag construction element and the first function construction element, wherein, responsive to data received from the tag construction element, the function device of the first function construction element is configured to perform the controllable function. The tag construction element is configured for data communication with the first function construction element when the tag construction element is mechanically connected to the first function construction element, and the tag construction element stores one or more of a tag identifier, data identifying an operational mode, an (Continued)

identifier identifying a behavioural pattern, and a sound file. Each of the plurality of function construction elements comprises coupling members configured for releasably interconnecting the function construction elements with each other.

20 Claims, 7 Drawing Sheets

(56) References Cited

U.S. PATENT DOCUMENTS

| | | | | |
|---|---|---|---|---|
| 5,451,178 | A * | 9/1995 | Yorozu | G09B 15/00 446/175 |
| 5,596,181 | A | 1/1997 | Bach | |
| 6,171,168 | B1 * | 1/2001 | Jessop | G09F 27/00 446/298 |
| 6,236,305 | B1 * | 5/2001 | Martin | G10H 1/34 340/384.73 |
| 6,443,796 | B1 | 9/2002 | Shackelford | |
| 6,524,159 | B1 * | 2/2003 | Kawarizadeh | A63H 5/00 446/397 |
| 6,547,624 | B1 | 4/2003 | Bojesen et al. | |
| 6,568,869 | B1 | 5/2003 | Murata | |
| 7,708,615 | B2 * | 5/2010 | Munch | A63H 33/042 446/484 |
| 8,354,918 | B2 | 1/2013 | Boyer | |
| 8,753,164 | B2 | 6/2014 | Hansen et al. | |
| 9,011,250 | B2 | 4/2015 | Condon et al. | |
| 9,167,611 | B2 | 10/2015 | Breckman et al. | |
| 10,625,173 | B2 * | 4/2020 | Kærsgaard | A63H 33/042 |
| 2003/0148703 | A1 | 8/2003 | Scott | |
| 2004/0092207 | A1 | 5/2004 | Hansen | |
| 2005/0215170 | A1 * | 9/2005 | Poesch | A63H 3/16 446/297 |
| 2006/0172787 | A1 | 8/2006 | Ellis et al. | |
| 2006/0215476 | A1 | 9/2006 | Owen | |
| 2008/0153559 | A1 | 6/2008 | de Weerd | |
| 2009/0264200 | A1 * | 10/2009 | Schwartz | A63F 13/12 463/40 |
| 2009/0305602 | A1 * | 12/2009 | Gaute | A63H 33/042 446/91 |
| 2010/0001923 | A1 * | 1/2010 | Zilber | A63F 3/00643 345/1.1 |
| 2010/0311300 | A1 * | 12/2010 | Hansen | A63H 33/042 446/91 |
| 2011/0021107 | A1 * | 1/2011 | Nag | A63H 33/042 446/91 |
| 2011/0143629 | A1 * | 6/2011 | Seymour | A63H 33/042 446/91 |
| 2011/0151743 | A1 * | 6/2011 | Munch | A63H 33/042 446/91 |
| 2012/0218211 | A1 * | 8/2012 | McRae | G06F 1/1684 320/108 |
| 2012/0258436 | A1 * | 10/2012 | Lee | G09B 19/003 434/362 |
| 2013/0059284 | A1 * | 3/2013 | Giedgowd, Jr. | A63H 3/36 709/219 |
| 2013/0217294 | A1 * | 8/2013 | Karunaratne | A63H 33/22 446/90 |
| 2013/0217295 | A1 * | 8/2013 | Karunaratne | A63H 30/04 446/124 |
| 2013/0302763 | A1 | 11/2013 | Edwards et al. | |
| 2013/0343025 | A1 | 12/2013 | Bdeir | |
| 2014/0127965 | A1 * | 5/2014 | Adam | A63H 33/042 446/91 |

FOREIGN PATENT DOCUMENTS

| | | | |
|---|---|---|---|
| EP | 1291138 | A2 | 3/2003 |
| EP | 2282315 | A1 | 2/2011 |
| GB | 2342813 | A | 4/2000 |
| JP | 2003190662 | A | 7/2003 |
| JP | 2011500116 | A | 1/2011 |
| JP | 2013517077 | A | 5/2013 |
| WO | WO 2006-042549 | A1 | 4/2006 |
| WO | WO 2006-092358 | A2 | 9/2006 |
| WO | WO 2007-137577 | A1 | 12/2007 |
| WO | WO 2009-047225 | A1 | 4/2009 |
| WO | WO 2010-018486 | A1 | 2/2010 |
| WO | WO 2010-023070 | A1 | 3/2010 |
| WO | WO 2013-017138 | A1 | 2/2013 |
| WO | WO 2013-122798 | A1 | 8/2013 |
| WO | WO 2013-183328 | A1 | 12/2013 |

OTHER PUBLICATIONS

International Search Report issued in related international application No. PCT/EP2015/060486, dated Nov. 4, 2015.

Written Opinion of the International Search Authority issued in related international application No. PCT/EP2015/060486, dated Nov. 4, 2015.

English Translation of SIPO's First Office Action issued in related patent application No. CN201580025262.6, dated Jul. 10, 2018.

Notice of Reasons for Refusal, issued in related Japanese application No. 2017-512419, dated May 9, 2019. (*Original and English language translation).

Non-Final Office Action including list of references, issued in corresponding U.S. Appl. No. 15/309,746, filed Mar. 13, 2018.

Final Office Action including list of references, issued in corresponding U.S. Appl. No. 15/309,746, filed Nov. 19, 2018.

Non-Final Office Action including list of references, issued in corresponding U.S. Appl. No. 15/309,746, filed Jun. 28, 2019.

Notice of Allowance including list of references, issued in corresponding U.S. Appl. No. 15/309,746, filed Dec. 23, 2019.

First Examination Report in related India App. No. 201617038413, dated Apr. 30, 2020.

Extended European Search Report issued in corresponding European patent application No. 21177516.8, dated Sep. 23, 2021, 8 pages.

Notice of Reasons for Refusal (Office Action) issued in corresponding Japanese patent application No. 2020-087248, dated Jul. 16, 2021, 5 pages (machine translation).

* cited by examiner

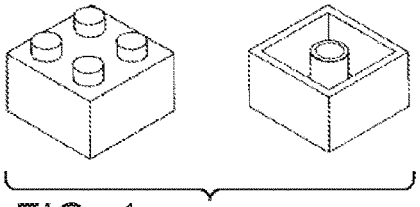
FIG. 1 - PRIOR ART
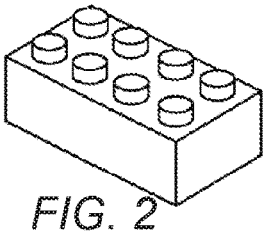
FIG. 2
PRIOR ART
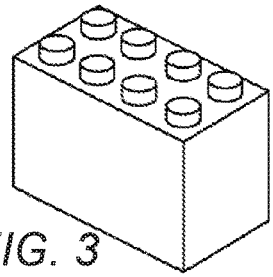
FIG. 3
PRIOR ART
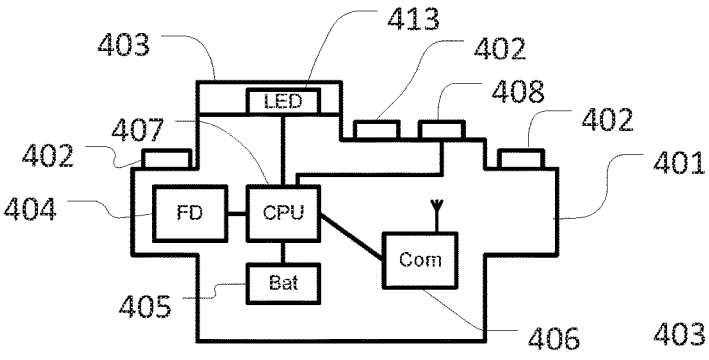
FIG. 4A
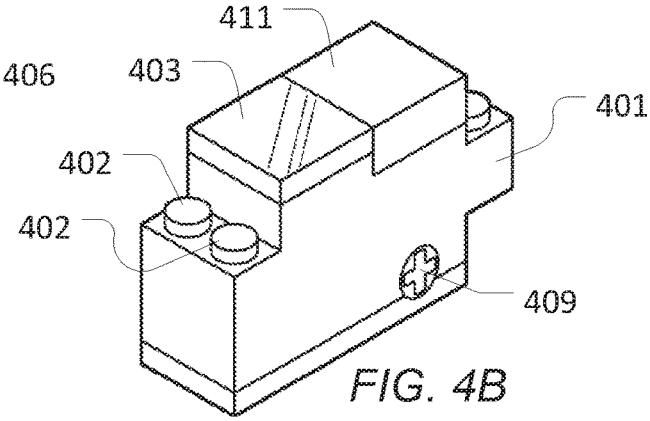
FIG. 4B
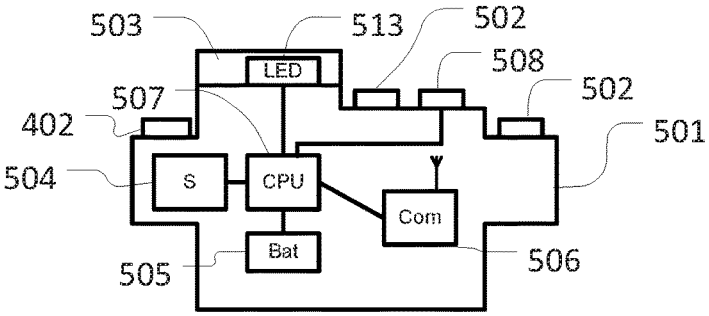
FIG. 5A
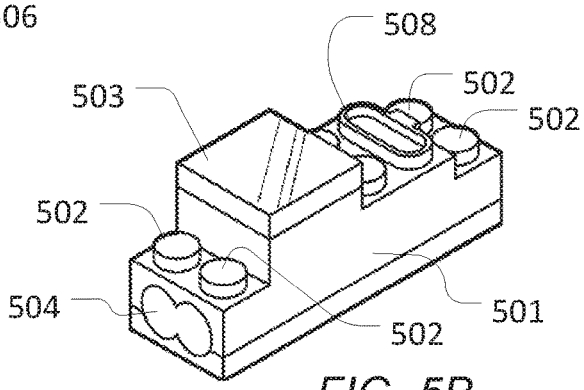
FIG. 5B

TOY CONSTRUCTION SYSTEM WITH FUNCTION CONSTRUCTION ELEMENTS

CROSS-REFERENCE TO RELATED APPLICATIONS

This application is a continuation of U.S. application Ser. No. 15/309,746, filed on 8 Nov. 2016, which is a U.S. National Stage Entry of International Application No. PCT/EP2015/060486, filed on 12 May 2015 and published on 19 Nov. 2015, as WO 2015/173246 A1, which claims the benefit of priority to Danish Patent Application No. PA 2014 70289, filed on 15 May 2014. The disclosure of each of the aforementioned patent applications is incorporated by reference herein in its entirety.

FIELD OF THE INVENTION

The invention relates to toy construction systems.

BACKGROUND

Toy construction systems have been known for decades. Over the years, simple box-shaped building blocks have been supplemented with dedicated construction elements with either a specific appearance or a mechanical or electrical function to enhance the play value. Such functions include e.g. motors, switches and lamps, but also programmable processors that accept input from sensors and can activate function elements in response to received sensor inputs.

Self-contained function construction elements exist which have a function device adapted to perform a preconfigured function, an energy source for providing energy to the function device for performing the function, and a trigger responsive to an external trigger event to trigger the function device to perform the function. Typically, such known function construction elements are designed for manual activation of a mechanical trigger and only provide a limited play value.

WO2007/137577 discloses a toy construction system comprising function elements and control elements. The function and control elements are electrically interconnectable via a system of wires and plugs, such that the function elements receive both electrical power and control signals from the control elements. Even though this system avoids the need for an electrical power source in the function elements, it requires a certain level of abstract thinking and technical insight in order to correctly interconnect the construction elements so as to construct functional toy models from such a system. In particular, an understanding of how a control structure constructed from such a construction system works requires basic knowledge about electricity and that electrical signals may be used to control functions. Moreover, this prior art system requires electrical connections, e.g. in the form of wires, between the elements, thus limiting the freedom to freely construct toy construction elements.

U.S. Pat. No. 8,354,918 discloses a method to elicit a behaviour in response to a simplex communication signal. In this prior art method a receiver device receives an encoded simplex communication signal including an identifier from a transmitter device. The method further comprises referencing a stored program in the receiver device to a stored program block corresponding to the identifier. The receiver device then initiates execution of the program block and renders a behaviour in accordance with or corresponding to the program block corresponding to the simplex communication signal. The receiver device includes a program database, wherein the receiver is programmed to reference a stored program block of the program database corresponding to the identifier. The receiver device also includes mechanisms to enable a behaviour in accordance with the program block to be audibly and visibly perceived.

GB 2342813 discloses an educational toy system that comprises a transmitting and receiving toy wherein the transmitting toy is capable of remotely controlling the receiving toy. The transmitting toy comprises a monitoring device which monitors for status changes such as detection of vibration, orientation, ultrasonic or infrared signals and, in response, sends output signals containing identification and status-dependent action data. The identification data identifies the receiving toy to be affected whilst the action data tells the toy what action to perform (eg production of movement, sound or light). The receiving toy compares the identification data with one or more stored id's and if it has a predefined relationship with one of the id's, performs the action corresponding to the action data. At least one of the identification data transmitted by the transmitting toy and the stored id's of the receiving toy may be programmed by the user. The receiving toy can be put into a programming mode wherein it listens for the identification data of a nearby transmitting toy and stores that data in its list of stored id's.

WO 2010/23070 discloses a toy construction system comprising construction elements with coupling members for releasably interconnecting construction elements, the toy construction system comprising function construction elements with such coupling members and each having a function device adapted to perform a controllable function and an energy source for providing energy to the function device for performing the controllable function, each function construction element comprising a light sensor for receiving visible light encoding a control signal; and a control circuit connected to the light sensor and to the function device and adapted to decode the received control signal and to control the controllable function responsive to the decoded control signal.

It is generally desirable to provide a toy construction system with new construction elements that are suitable for use in such a system, and that will enhance the educational and play value of the system. Even though the above prior art systems provide for a wired or wireless control of functions in a function element, it remains desirable to provide a toy construction system wherein a set of function construction elements may easily be used in different toy construction models and interchangeably with other function construction elements. Moreover it is desirable to provide a toy construction system that allows users, in particular children, to construct multiple interactive toy models in a user-friendly, efficient, yet flexible and reliable manner without the need for a detailed knowledge of control structures and wireless data communication.

SUMMARY

Disclosed herein are aspects of a toy construction system comprising a plurality of interactive construction elements.

According to a first aspect, the plurality of interactive construction elements comprises at least two types of interactive construction elements, namely a plurality of function construction elements and one or more input construction elements. Each interactive construction element comprises a wireless communication interface for communicating with one or more other interactive construction elements of the plurality of interactive construction elements. Each input construction element comprises an input device operable to receive an input and is configured to transmit, responsive to the received input, a control signal to at least a subset of the function construction elements. Each function construction element comprises a function device adapted to perform a controllable function. Each function construction element is configured to transmit an identification signal to at least a subset of the function construction elements, and to control the controllable function responsive to a control signal received from the input construction elements and/or to one or more identification signals received from respective one or more other function construction elements of the plurality of function construction elements. Hence, each function construction element may be wirelessly controlled by at least one of the input construction elements, and the behaviour of the function construction elements may further be made dependent on the presence of one or more other function construction elements. Consequently, the function construction elements may be controlled to exhibit a relatively complex behaviour, including a group or cooperative behaviour without requiring the user to have advanced technical or programming skills.

The identification signal may be indicative of a type of function construction elements and/or of one or more operational parameters of the function construction element transmitting the signal. For example, the identification signal may be indicative of a group identifier, thus allowing assigning the interactive construction element to one or more separate groups where the members of each group may cooperate with each other or otherwise influence each other's behaviour. It will be appreciated that the identification signal may be transmitted in a number of ways, e.g. as a broadcast signal; the identification signal may be transmitted periodically by each function construction element and/or responsive to a trigger event. For example, the identification signal may be a response signal transmitted responsive to a request or inquiry signal from another interactive construction element. In some embodiments all interactive construction elements, i.e. both the function construction elements and the input construction elements are configured to transmit and/or receive respective identification signals. The identification signal may include information as to whether the sending interactive construction element is an input construction element or a function construction element. The control signal and the identification signal may be transmitted as respective messages having a predetermined message structure. In some embodiments the control signal and the identification signal may have the same message structure. Each message may include a group identifier. Each message may further include one or more of the following: a message type, a value, an element type, an element/node identifier. In some embodiments, the system comprises a global message type which is received and processed by all interactive construction elements regardless of their respective group identifiers.

In some embodiments, each interactive construction element comprises a user-operable selector allowing a user to select one of a predetermined set of group identifiers. Each interactive construction element may comprise a group indicator configured to output, responsive to a selected group identifier, an indication indicative of the selected group identifier. Each function construction element may be configured to selectively control the function device of said function construction element responsive to a control signal received from an input construction element having a selected group identifier matching a selected group identifier of the function construction element.

Hence, a system is provided that allows users to easily group the interactive construction elements into one, two or even more groups such that the interactive construction elements only interact with other interactive construction elements assigned to the same group. The assignment of groups is performed in an easy-to-learn manner and the indicators allow a user to immediately realise which interactive construction elements are assigned to which group. Moreover, as each interactive construction element, i.e. both the control and the function construction elements, comprise user-operable selectors and group indicators, all interactive construction elements may easily be assigned and reassigned to different groups in a large variety of different group configurations.

The indications of the respective group identifiers are preferably uniform for all interactive construction elements, i.e. the group indicators of all interactive construction elements that have the same selected group identifier are configured to output the same group indication different from the group indications associated with other groups. Here the terms same and different are intended to refer to a property of the indication that is easily perceived by a user as being the same or different, e.g. light of respective colours, such as red light, blue light and green light, respectively. In some embodiments the user-operable selectors and the indicators of all interactive construction elements have a uniform shape and size and a uniform functionality.

In some embodiments, the indication indicative of the selected group identifier comprises a visible indication. For the purpose of the present description, the term visible indication is intended to comprise an output that is visible by the human eye, e.g. in the form of light having wavelengths predominantly chosen from a wavelength range between about 380 nm and about 780 nm. When the visible indication comprises emission of coloured light, e.g. using a part of the optical spectrum such as red light (e.g. predominantly in the wavelength range of about 625 nm and about 740 nm), green light (e.g. predominantly in the wavelength range of about 520 nm and about 570 nm) or blue light (e.g. predominantly in the wavelength range of about 440 nm and about 490 nm), it is easy for the user to detect and to distinguish the different group indications from each other and from ambient light.

In some embodiments, the control signal comprises a group identifier of the input construction element sending the control signal. Hence, the receiving function construction element may determine the group identifier associated with a received control signal and, thus, selectively react on the received signal or ignore it.

In some embodiments, each interactive construction element is configured, upon a change from a deactivated to an activated mode, to

- detect a presence of at least one other interactive construction element in a proximity of the interactive construction element;
- responsive to a detection of said presence, to detect a group identifier of the detected other interactive construction element and to automatically set a group identifier of the interactive construction element to be equal to the detected group identifier of the detected other interactive construction element.

Hence, when an interactive construction element is activated, e.g. powered on or activated from a power-conserving stand-by or sleep state into an active state, the interactive construction element may automatically be assigned to a group based on a detected, already existing group of one or more other interactive construction elements within a proximity of the newly activated interactive construction element. The proximity may e.g. be defined by the communication range of the interactive construction element. Consequently, the creation of groups of interactive construction elements is further facilitated. The detection may be based on any suitable detection mechanism, e.g. on an identification signal received from another interactive construction element. In some embodiments, the detection mechanism is responsive only to activated interactive construction elements, or only to interactive construction elements of a selected group, type, and/or the like.

When the interactive construction element, upon activation, detects multiple other interactive construction elements in its proximity where the other interactive construction elements are assigned to different groups, the automatic assignment may select one of these groups based on a suitable selection criterion, e.g. by selecting the group of the element being detected with the largest signal strength, the first detected group, the group having the most detected members, etc. or a combination of the above.

In some embodiments the system may comprise a mechanism for associating a first group with a second group. For example, each interactive construction element may receive a control signal indicative of respective group identifiers of two groups that are to be associated to each other. Each interactive construction element being assigned to one of the groups may then store the group identifier of the corresponding other, associated group. In some embodiments, the information about which groups are associated with one another may e.g. be broadcast as a global message received and processed by all interactive construction elements. A function construction element may thus react not only to control messages directed to its own group but also to control messages directed to its associated group or groups. Alternatively or additionally, the function construction element may select its own function/behaviour based not only on the detected presence of other interactive construction elements of its own group but also to the detected presence of interactive construction elements of the associated group(s). It will be appreciated that, in some embodiments, more than two groups may be associated with each other.

A particularly user-friendly yet cost-efficient toy construction system is provided when the interactive construction element is configured, responsive to an activation of the user-operable selector, to change the selected group identifier from a current group identifier to a subsequent group identifier from the set of group identifiers, e.g. from a cyclic sequence of group identifiers. Consequently, a low-cost yet easy-to-use interface for assigning interactive construction elements to respective groups is provided. Accordingly, in some embodiments, the user-operable selector and the group indicator may be the only user-interface elements of the interactive construction element. In some embodiments, the indicator and the user-operable selector are combined into a single element such as a push button including a multi-colored light source, e.g. multiple LEDs.

In some embodiments, the user-operable selector may have additional functions, other than selecting a group. In particular, the interactive construction element may be configured, when in a deactivated mode and responsive to an activation of the user-operable selector, to change to an activated mode; and, when in the activated mode and responsive to an activation of the user-operable selector, to change the selected group identifier from a current to a subsequent group identifier; and when in the activated mode and responsive to an extended activation of the user-operable selector, longer than a predetermined threshold, to change to the deactivated mode. Hence, the same selector may be used to power ON/OFF (or otherwise activate/deactivate) the construction elements and to assign the element to a group. Moreover, alternatively or additionally, the user-operable selector may be operable to allow a user to select between other types of operational modes, other than the selection of a group. Similarly, the group indicator may be operable to indicate other types of operational modes in addition to or alternative to a group identification.

It will be appreciated that the selector may have different shapes and sizes and may be operated in a variety of ways. For example, the selector may be a push button or other push/pressure-activated element or another form of switch, slider, etc.

The present disclosure relates to different aspects including the toy construction system described above and in the following, corresponding interactive construction elements and other apparatus, systems, methods, and/or products, each yielding one or more of the benefits and advantages described in connection with the first mentioned aspects, and each having one or more embodiments corresponding to the embodiments described in connection with the first mentioned aspect and/or disclosed in the appended claims.

According to a second aspect, disclosed herein are embodiments of a toy construction system comprising a plurality of interactive construction elements each configured to be selectively operable in each of a number of operational modes and each interactive construction element comprising:

- a wireless communications interface for communicating with one or more other ones of the interactive construction elements; and
- a user-operable selector allowing a user to select one of the number of operational modes;

wherein each interactive construction element is configured, upon a change from a deactivated to an activated mode, to detect a presence of at least one other interactive construction element in a proximity of the interactive construction element; responsive to a detection of said presence, to detect a current operational mode of the detected other interactive construction element and to automatically set an operational mode of the interactive construction element to be equal to the detected current operational mode of the detected other interactive construction element.

Hence, when an interactive construction element is activated, e.g. powered on or activated from a power-conserving stand-by or sleep state into an active state, the interactive construction element is automatically assigned to one of a set of operational modes based on a detected operational mode of one or more other interactive construction elements within a proximity of the newly activated interactive construction element. The proximity may e.g. be defined by the communication range of the interactive construction element. Consequently, the assignment of operational modes of multiple interactive construction elements is greatly facilitated.

Each operational mode may be distinguished from the other operational modes by one or more characteristic properties of the operational mode. In some embodiments, each operational mode is associated with a predetermined group identifier, i.e. the operational mode defines which group of interactive construction elements the interactive construction element currently belongs to. The behaviour of the interactive construction element may thus depend on which other interactive construction elements are currently in the same operational mode, i.e. members of the same group. As mentioned above, there may be two types of interactive construction elements: function construction elements and input construction elements as described herein. Each function construction element may thus be configured to selectively control a function device of said function construction element responsive to a control signal received from an input construction element having a selected operational mode matching a selected operational mode of the function construction element.

Generally, the wireless communications interface of the interactive construction elements may implement any suitable wireless communications technology, e.g. using radio-frequency communication following a suitable communications protocol. In some embodiments, the wireless communications technology is a short-range technology. The communications range of the wireless communication may be at least 0.5 m, e.g. at least 1 m. In most situations a communications range of less than 10 m and, in most cases even less than 5 m is sufficient, even though in some embodiments longer ranges may be acceptable or even desirable. In some embodiments the input construction elements and/or the function construction elements may include a transceiver so as to allow two-way communication between different interactive construction elements. The control signal may be encoded into a wireless signal in any suitable way, e.g. by an amplitude modulation, a frequency modulation, and/or a more complex modulation technique.

Embodiments of the interface between control and function construction elements are operable without moving parts and do not require the establishment of electrical contact between the control and the function construction elements, thereby providing a mechanically robust system that is suitable also for small children.

In some embodiments, a function construction element is configured to detect a type and/or identity of one or more other interactive construction elements in a proximity of the function construction elements; and to control the function device of said function construction element responsive to the detected type and/or identity. Hence, the behaviour of a function construction element may be made dependent on which other interactive construction elements are within a proximity or even assigned to the same group. For example, the function construction element may have stored thereon multiple programs or multiple functional patterns and select one or more of these programs/patterns responsive to the type and/or identity of the other interactive construction elements within a proximity and/or within the same group. For example, each function construction element may comprise a data structure, e.g. a list or matrix or a database of executable instructions, program blocks, functions, subroutines or the like associating one or more sets of interactive construction elements with respective executable instructions, program blocks, etc. It will be appreciated that the list, matrix or database may include pointers such as memory addresses, identifying to instructions, program blocks, functions etc. When the function construction element has detected all interactive construction elements of one of the sets to which a set of instructions, a program block, or the like, is associated, the function construction element selects and executes the associated instructions/program block/function etc. Hence, function construction elements may be configured to reference a stored set of instructions or program block of the program data structure corresponding to the detected interactive construction elements. The behaviour of the function construction element may thus be made dependent on which other interactive construction elements are present in a proximity of the function construction element. In some embodiment, the selection of an executable set of instructions may be made responsive to the detection of a set of other interactive construction element of a predetermined group, e.g. the same group as the function construction element itself (and/or an associated group as described herein), as defined by the group identifier of the function construction element. It will be appreciated that the function construction element may be controlled by firmware. The firmware may comprise respective sets of instructions that correspond to respective behavior.

In some embodiments, the one or more input construction elements each comprise an input device in the form of a sensor responsive to a predetermined sensor input; and the input construction element is adapted, in response to the predetermined sensor input, to output a control signal corresponding to the predetermined sensor input. Consequently, a control interface between the input construction elements and the function construction elements is provided. Hence, the control mechanism is intuitive and easy to work with also for smaller children. The toy construction system may comprise a plurality of input construction elements responsive to different predetermined sensor inputs. Examples of sensor inputs include a mechanical force, a push action, a tilt orientation, a pull action, a rotation, a human manipulation, a touch, a proximity of an object, an electrical signal, a radio frequency signal, an optical signal, a visible light signal, an infrared signal, a magnetic signal, a temperature, a humidity, a radiation. The control signal may include a value indicative of the presence or absence of a sensed sensor input and/or of a quantitative degree of the sensor input, e.g. a sound pressure, a tilt angle, a light intensity, etc.

It is a further advantage of embodiments of the toy construction system described herein, that function construction elements can easily be interchanged within a given toy structure without having to change the control interface. A toy construction system may thus comprise a plurality of function construction elements whose function devices are adapted to perform different functions. The controllable function may be a user-perceptible function, such as a motion, a generation of an audible sound signal, a generation of an inaudible sound signal, a generation of an electrical signal, a generation of a visible light signal, a generation of an invisible light signal, a generation of a radio frequency signal, and/or the like.

Each function construction element may further comprise an energy source for providing energy to the function device for performing the controllable function.

In some embodiments, each interactive construction element comprises coupling members configured for releasably interconnecting the interactive construction elements with each other.

In some embodiments, the toy construction system comprises toy construction elements—e.g. the interactive construction elements described herein and/or conventional toy construction elements—having a top surface, a bottom surface, and coupling members placed on at least one of the top and the bottom surface; wherein the construction elements have a uniform height defined between the top and bottom surfaces; wherein each interactive construction element comprises a first surface; wherein the user-operable selector projects out from the first surface and has a height relative to the first surface less than or equal to the uniform height. Consequently, when a first toy construction element is attached to the first surface, a second toy construction element may be connected to the first toy construction element and extend above and partly or completely across the selector, thereby facilitating a flexible integration of the interactive construction element into a toy model. In particular, in some embodiments, each of the interactive construction elements has a top surface, a bottom surface, and at least one side surface; wherein said coupling members are placed on at least one of the top and the bottom surface; and wherein the user-operable selector is arranged on said top surface.

In some embodiments, the coupling members are adapted to define a direction of connection and to allow interconnection of each construction element with another construction element in a discrete number of predetermined relative orientations relative to the construction element; and all user-operable selectors are arranged to be activated from a predetermined direction relative to the defined direction of connection. Similarly, all indicators may be arranged to at least predominantly be visible from a predetermined direction relative to the defined direction of connection. Hence, such a toy construction system allows the construction of a toy structure where the control and function elements are interconnected with other construction elements of the toy construction system such that the user-operable selectors and indicators are easily accessible/visible. When the user-operable selectors and/or the indicators of all function construction elements and/or all input construction elements are arranged in a uniform manner relative to the coupling members, different function construction elements and/or control elements may easily be interchanged in a given toy construction model without interfering with an easy control of the interactive features of the model by a user. In some embodiments, the coupling members are arranged in one or more regular planar grid of coupling member locations; the grid defines the direction of connection, e.g. normal to the plane of the grid. In some embodiments the user-operable selector defines an activation surface where the selector is configured to be activated, e.g. by touch or pressure, across the entire activation surface. Preferably the interaction surface has a dimension in one or two directions that is equal or larger than the pitch distance between neighbouring coupling members in the grid of coupling member locations, preferably equal or larger than twice the pitch distance.

The coupling members may utilise any suitable mechanism for releasably connecting construction elements with other construction elements. In some embodiments, the coupling members comprise one or more protrusions and one or more cavities, each cavity being adapted to receive at least one of the protrusions in a frictional engagement.

In some embodiments, the toy construction system comprises a tag construction element connectable to one of the interactive construction elements. To this end, the tag construction element may comprise coupling members corresponding to the coupling members of the interactive construction elements. The tag construction element is configured for data communication between the tag construction element and the interactive construction element when the tag construction element is connected to the interactive construction element. For example, when a tag is connected to a function construction element, the function construction element may be configured to control the function device responsive to data received from the tag construction element. To this end, the tag construction element may comprise a memory for storing data. The communication may be via a wired connection or a wireless connection, e.g. a near-field wireless connection. The transmitted data may comprise an identifier causing the function construction element to control the function device responsive to the received identifier. Alternatively or additionally, the data may comprise control parameters and/or program code for controlling the function device.

In some embodiments, the system further comprises a data processing device including a wireless communications interface configured to communicate with one or more of the interactive construction elements; and including a graphical user interface configured to display a user interface responsive to the communicated control signals. The data processing device may be a suitably programmed computer such as a portable computer, a tablet computer, a smartphone or another programmable computing device having a graphical user-interface and a wireless communications interface. The data processing system, when suitably programmed, may execute a program that causes the data processing system to simulate an input construction element and/or a function construction element. In particular, the data processing system may be configured to transmit a control signal for controlling the function of a function construction element or to receive a control signal from an input construction element and to perform a function responsive to the received control system, e.g. control the behaviour of a figure in a virtual world, a game or the like. The data processing system may further be configured to send and/or receive and process identification signals as described herein. The data processing system may further provide functionality allowing the user to assign a group identifier to the data processing system. The data processing system may thus emit control signals comprising the selected group identifier or selectively perform a function responsive to a received control signal comprising the selected group identifier. In some embodiments, the data processing system may provide functionality allowing two or more groups of interactive construction elements to be associated with each other. In some embodiments, the data processing system may comprise a user-interface allowing a user to define one or more such associations. The data processing system may thus transmit one or more control signals causing the interactive construction elements of the relevant groups to record the association, e.g. by storing the group identifier(s) of one or more associated groups. The data processing system may further be configured to read and/or write data to a tag construction element. To this end, the data processing system may comprise an interface for connecting a tag construction element to the data processing system.

Embodiments of the toy construction system allow a user to construct a large variety of functions and functional relationships in a uniform and well-structured manner and with a limited set of different construction elements. For example, a toy construction system may be provided as a toy construction set comprising a number of input construction elements having different sensors and a number of function construction elements implementing respective functions. Optionally, such a toy construction set may comprise one or more of the following: a number of control and function construction elements, conventional construction elements, an instruction manual, and/or the like.

BRIEF DESCRIPTION OF THE DRAWINGS

FIGS. 1-3 each show a prior art toy construction element,

FIGS. 4A-B show an embodiment of a function construction element of a toy construction system as disclosed herein, FIGS. 5A-B show embodiments of an input construction element of a toy construction system as disclosed herein.

DETAILED DESCRIPTION

Figure 6:
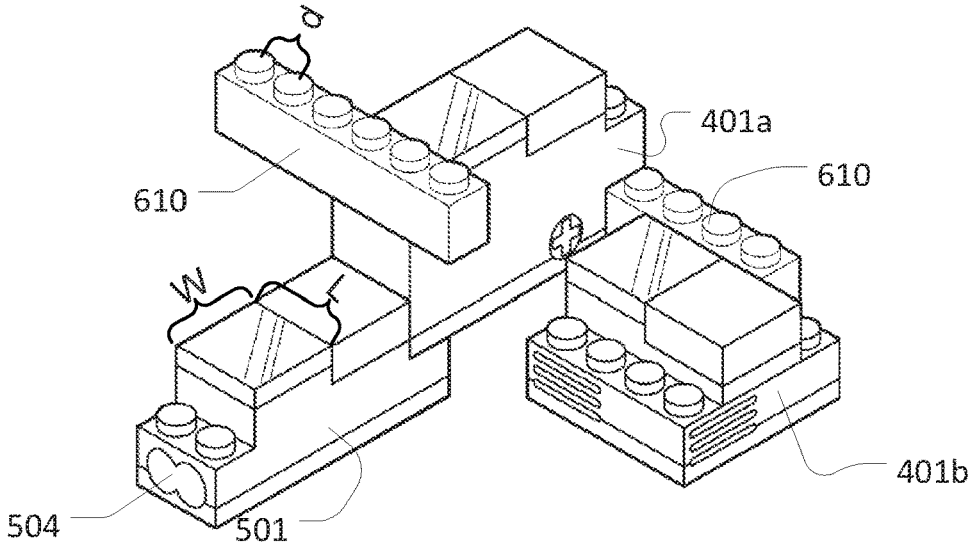
FIGS. 6-8 show examples of a toy structure constructed from toy construction elements and interactive construction elements as disclosed herein, FIGS. 9A-F schematically illustrate the operation of an interactive construction element.

Various aspects and embodiments of toy construction systems disclosed herein will now be described with reference to toy construction elements in the form of bricks. However, the invention may be applied to other forms of construction elements for use in toy construction sets.

In FIG. 1 is shown a toy construction element with coupling studs on its top surface and a cavity extending into the brick from the bottom. The cavity has a central tube, and coupling studs on another brick can be received in the cavity in a frictional engagement as disclosed in U.S. Pat. No. 3,005,282. FIGS. 2 and 3 show other such prior art construction elements. The construction elements shown in the remaining figures have this known type of coupling members in the form of cooperating studs and cavities. However, other types of coupling members may also be used in addition to or instead of the studs and cavities. The coupling studs are arranged in a square planar grid, i.e. defining orthogonal directions along which sequences of coupling studs are arranged. The distance between neighbouring coupling studs is uniform and equal in both directions. This or similar arrangements of coupling members at coupling locations defining a regular planar grid allow the toy construction elements to be interconnected In a discrete number of positions and orientations relative two each other, in particular at right angles with respect to each other.

In the following, examples of interactive construction elements, in particular function construction elements and input construction elements will be described as well as their operation and interaction with each other.

FIGS. 4A-B show an example of a function construction element 401. In particular, FIG. 4A shows a schematic block diagram of the function construction element while FIG. 4B shows a perspective view of the function construction element. The function construction element is generally shaped as an orthogonal polyhedron with flat side faces and having coupling members 402 extending from its upper surfaces and cavities extending into its bottom surfaces (not explicitly shown). However other shapes and sizes of construction elements may be used. The coupling members are arranged in planar, regular, parallel grids defining the coupling locations. The function construction element has a user-operable selector in the form of a push button 403 on its uppermost surface. The push button has a push-sensitive activation surface that extends across two coupling locations in each direction. The function construction element further comprises an indicator in the form of a multi-coloured light source 413 integrated into the push button 403 and configured to selectively emit light of different colours, such as red light, blue light, green light, etc. For example, the multi-coloured light source may comprise a number of LEDs. It will be appreciated that other embodiments of a function construction device may comprise other types of selectors and/or indicators.

The function construction element 401 comprises a control circuit 407, e.g. a microcontroller, a microprocessor, or other suitable processing unit, operably connected to the push button and the light source. The function construction element 401 further comprises a function device 404 connected to the control circuit 407. The construction element 401 further comprises a transceiver 406 connected to the control circuit and operable for radio-frequency communication with other interactive construction elements. The function construction element further comprises a battery 405 or other suitable power source, for providing power to the control circuit, the function device, the light source and the transceiver. The walls of the function construction element 401 define a housing which accommodates the processing unit 407, the function device 404, the battery 405, and the transceiver 406.

The control circuit 407 is configured to control the function device responsive to signals received via the transceiver and to control the transceiver and the multi-coloured light source. Generally, the signals signal may be provided by another interactive construction element in a proximity of the function construction element 401. In particular, when the function construction element 401 is used as a part of a system that includes an input construction element as described below, the function construction element may receive a control signal from a corresponding transceiver of an input construction element. Alternatively, the control signal may be received from a computer or other processing device. The function construction element is further configured to receive, via transceiver 406, identification signals from other interactive construction elements, and to broadcast identification signals.

The transceiver 406 may be operable to transmit and receive radio-frequency signals in a suitable frequency band, e.g. in one of the ISM bands used for short-range communications technology. In fact the radio-frequency communication may utilise any suitable communications technology for communicating data, such as Bluetooth, IEEE 802.15.4, IEEE 802.11, ZigBee, etc. It will be appreciated, however, that other communications technologies may be used, including technologies based on light, such as infrared light, or another wireless technology.

The function device may be any suitable device for performing a function, such as a function that provides a user-perceptible effect, such as a visible or audible effect. In the example of FIG. 4B, the function device is a motor and the function construction element comprises a coupling member for receiving a shaft that may be rotatably driven by the motor. Other examples of function devices may include any suitable mechanical and/or electrical device, arrangement or circuitry adapted to perform one or more mechanical or electrical function.

Examples of a mechanical function that the function construction elements described herein can perform include driving a rotating output shaft, winding-up a string or a chain which enables pulling an object closer to the function construction element, moving a hinged part of the function construction element which enables e.g. opening or closing a door, ejecting an object, rotating a turntable, moving a linear actuator, etc. Such mechanical motions can be driven by an electric motor powered by a battery or a rechargeable electric capacitor, or another suitable power source.

Examples of an electrical function that the function construction elements described herein can perform include operating a switch with accessible terminals, emitting constant or blinking light, activating several lamps in a predetermined sequence, emitting audible sound such as beep, alarm, bell, siren, voice message, music, synthetic sound, natural or imitated sound simulating and stimulating play activities, recording and playback of a sound, emitting inaudible sound such as ultrasound, emitting a radio frequency signal or an infrared signal to be received by another component, providing visible output via a display, etc.

Hence, examples of function devices include a light source such as a lamp or LED, a sound generator, a motor, a hinged part, a rotatable shaft, a signal generator, s linear actuator, a display, or the like. A toy construction system may comprise several of such function construction elements responsive to control signals and providing different functions.

The function construction element may also comprises an electrical connector 408 allowing a tag construction element 411 to be electrically connected to the control circuit so as to allow the control circuit to receive data, such as an identifier and/or other data, from a memory of the tag construction element 411. FIG. 4A shows the function construction element 401 without a tag construction element attached to it, while FIG. 4B shows the function construction element 401 with a tag construction element 411 attached to the connector 408. The control circuit may thus control operation of the function device responsive to a received control signal and responsive to the data received from the tag construction element. Alternatively or additionally, as will be described in greater detail below, the control circuit may enter respective operational modes or select respective group identifiers responsive to the data received from the tag construction element The push button 403 is operable to provide a user interface—in some embodiments the only user-interface—allowing a user to control operation of the function construction element and, in particular, to bring the function construction element in different operational modes, e.g. by assigning respective group identifiers to the function construction element, as will be described in greater detail above. The multi-coloured light source 413 is operable to provide visible feedback to the user—in addition to any user-perceptible function provided by the function device 404—about the operational mode and/or the group identifier of the function construction device. In some embodiments the multi-coloured light source is configured to illuminate an illuminated surface. The illuminated surface may be large enough such that it extends across two coupling locations in each direction. In particular, in some embodiments, the entire push-sensitive activation surface of the push button may be illuminated. The function and use of the push button and multi-coloured light source will be described in greater detail below. The control circuit 407 is further operable to receive, via the transmitter 406, indications of the respective operational modes of other interactive construction elements in the proximity of the function construction element 401, and to control the behaviour of the function construction element 401 responsive to the received indications. For example, control signals received from input construction elements may include a group identifier or other data indicative of the operational mode of the input construction element from which the control signal originates. The control circuit 407 selectively activates the function device 404 responsive to control signals only if the received group identifier or other data matches the currently selected group identifier or other operational mode of the function construction element 401.

FIGS. 5A-B illustrate examples of an input construction element 501. In particular, FIG. 5A shows a schematic block diagram of an example of an input construction element while FIG. 5B shows a perspective view of another example of an input construction element. Each input construction element is generally shaped as an orthogonal polyhedron with flat side faces and having coupling members 502 extending from its upper surfaces and cavities extending into its bottom surfaces (not explicitly shown). However other shapes and sizes of construction elements may be used. The input construction element has a user-operable selector in the form of a push button 503 on its uppermost surface, an indicator in the form of a multi-coloured light source 513 integrated into the push button, a control circuit 507, a transceiver 506, and a battery 505, all as described in connection with the function construction element 401 above. However, instead of a function device, the input construction element 501 comprises a sensor 504 or other input device connected to the control circuit 507. The walls of the input construction element 501 define a housing which accommodates the processing unit 507, the sensor 504, the battery 505, and the transceiver 506. It will be appreciated that, in other embodiments, an interactive construction element may comprise a sensor as well as a function device.

The control circuit 507 is configured to receive a sensor signal from the sensor 504, to generate a control signal responsive to the received sensor signal, and to transmit the generated control signal via the transceiver 506.

The input construction element also comprises an electrical connector 508 allowing a tag construction element (not shown) to be electrically connected to the control circuit so as to allow the control circuit to receive data, such as an identifier and/or other data, from a memory of the tag construction element. The control circuit 507 may thus be configured to generate the control signal responsive to the received sensor signal and responsive to the data received from the tag construction element. Alternatively or additionally, as will be described in greater detail below, the control circuit may enter respective operational modes, such as select respective group identifiers, responsive to the data received from the tag construction element.

The push button 503 is operable to provide a user interface—in some embodiments the only user-interface—allowing a user to control operation of the input construction element and, in particular, to bring the input construction element in different operational modes, e.g. by assigning respective group identifiers to the input construction element, as will be described in greater detail above. The multi-coloured light source 513 is operable to provide visible feedback to the user about the operational mode and/or the group identifier of the control construction device. As was described in connection with the function construction element of FIG. 4, the multi-coloured light source 513 is configured to illuminate an illuminated surface of the push button. The control circuit inserts an identifier and/or other data indicative of the selected operational mode, e.g. the selected group identifier, in the control signal(s) transmitted to the interactive construction elements and/or otherwise communicates the selected operation state to other interactive construction elements in the proximity of the input construction element.

The sensor 504 of the input construction element 501 is responsive to a predetermined sensor input. In the example of FIG. 5B, the sensor is a proximity sensor for detecting the proximity of another object. Other examples of sensors may be responsive to other inputs such as mechanical forces, push, pull, rotation, tilt, human manipulation, touch, electrical signals, radio frequency signals, optical signals, visible light signals, infrared signals, magnetic signals, temperature, humidity, radiation, etc. The sensor may be configured to provide a binary signal, e.g. indicative of the presence or absence of an input. Alternatively or additionally, the sensor may be configured to generate a multi-level or even continuous signal indicative of multiple different inputs and/or indicative of a level or magnitude of activation. Accordingly, the generated control signal may be indicative of a property of the received sensor input, e.g. a direction of a rotation or tilt, or a degree of the detected quantity, e.g. the speed of a rotation or motion, a force, a temperature, a sound pressure, a light intensity, a tilt angle, etc. A toy construction system may comprise several input construction elements, each comprising a sensor responsive to a respective sensor input. Preferably, each input construction element is responsive to only a particular type of physical events/conditions.

The input construction elements and/or function construction elements may be used as a part of a toy building set comprising construction elements with coupling members for releasably interconnecting construction elements, e.g. the known bricks shown in FIGS. 1-3. A toy construction set may comprise a plurality of function construction elements and/or a plurality of input construction elements.

Preferably, the push buttons of all input construction elements and all function construction elements have a uniform shape and size and they are operated in the same manner and provide indications of the respective interactive construction element in a uniform manner. Moreover, the push buttons of all interactive construction elements may be arranged in a uniform manner relative to the coupling members, e.g. to the coupling studs on the top surface and/or to the coupling cavity in the bottom of toy construction elements.

Figure 7:
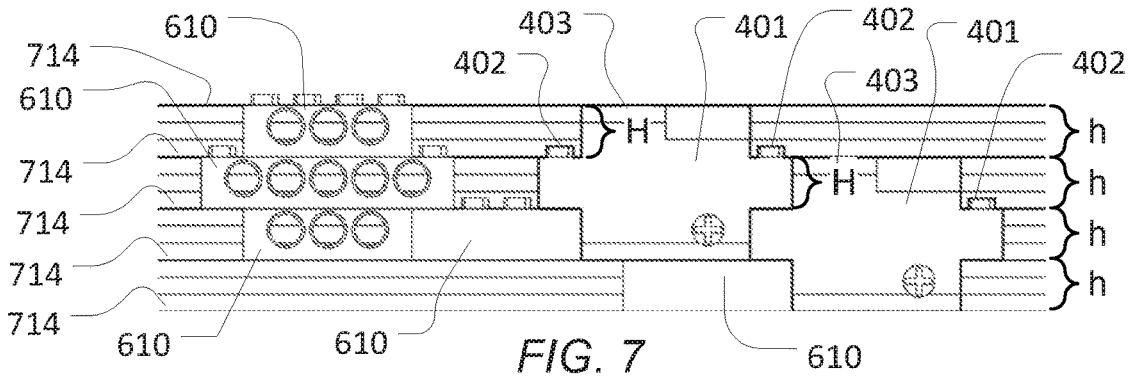
Figure 8:
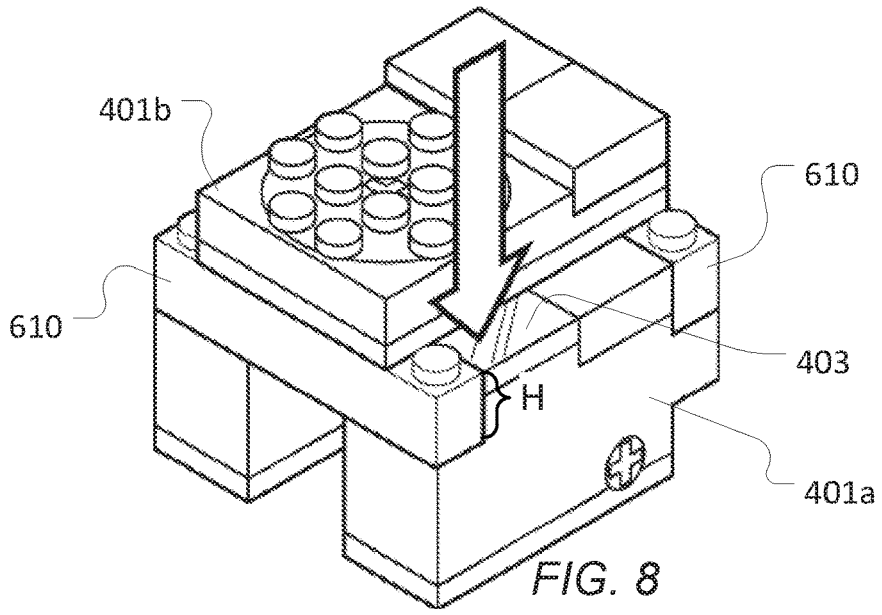

FIGS. 6-8 show examples of toy structures constructed from toy construction elements and interactive construction elements as disclosed herein. The toy structure of FIG. 6 is constructed from two conventional toy construction elements 610 and three interactive construction elements as described herein, namely an input construction element 501 and two function construction elements 401*a,b*. In this example, function construction element 401*a* comprises a motor while function construction element 401*b* comprises a sound generator. Input construction element 501 comprises a proximity sensor 504. During operation, when the input construction element 501 detects the proximity of an object, it transmits a control signal which, when received by the function construction elements 401*a,b*, causes the respective functions of the function construction elements to be activated.

FIG. 7 shows a side view of another toy structure which is constructed from conventional toy construction elements 610 and two function construction elements 401. In this example, function construction elements 401 each comprises a motor. During operation, function construction elements 401 may receive a control signal from an input construction element (not shown) that is not physically attached to the toy structure but located within the communication range of the transmitters of the function construction elements 401. FIG. 7 further illustrates that the construction elements have uniform heights (or integer multiples thereof) such that the coupling members are arranged in parallel planes 714 where the planes are spaced apart from one another by a distance h or an integer multiple thereof. The push button 403 of each function construction element 401 has a height H relative to a plane comprising coupling members 402 of the corresponding function construction element, where the height H matches the height h between planes of coupling members In the toy construction system. Consequently, in the toy structure, the activation surface of the push button 403, which is comprised in the light emitting surface of the multi-coloured light source, is level with one of the planes of coupling members in the toy structure.

Consequently, as illustrated in FIG. 8, another toy construction element—in this example another function construction element 401*b*—may be connected on top of construction elements 610 which, in turn, are connected to the coupling members of a function construction element 401*a* such that the other construction element 401*b* extends across the push button 403 without interfering with the operation of the push button.

Moreover, as the activation surface of push button 403 has a length L and a width W (as illustrated in FIG. 6), each equal to twice the pitch distance d between adjacent coupling members (see FIG. 6), the activation surface of push button 403 is still visible and accessible, even when partly covered by another construction element, as illustrated in FIG. 8. While FIG. 8 illustrates the shape, size and position of the push button with reference to an example of a function construction element, it will be appreciated that the push button of input construction elements may be shaped, sized and position in the same manner.

Figure 9:
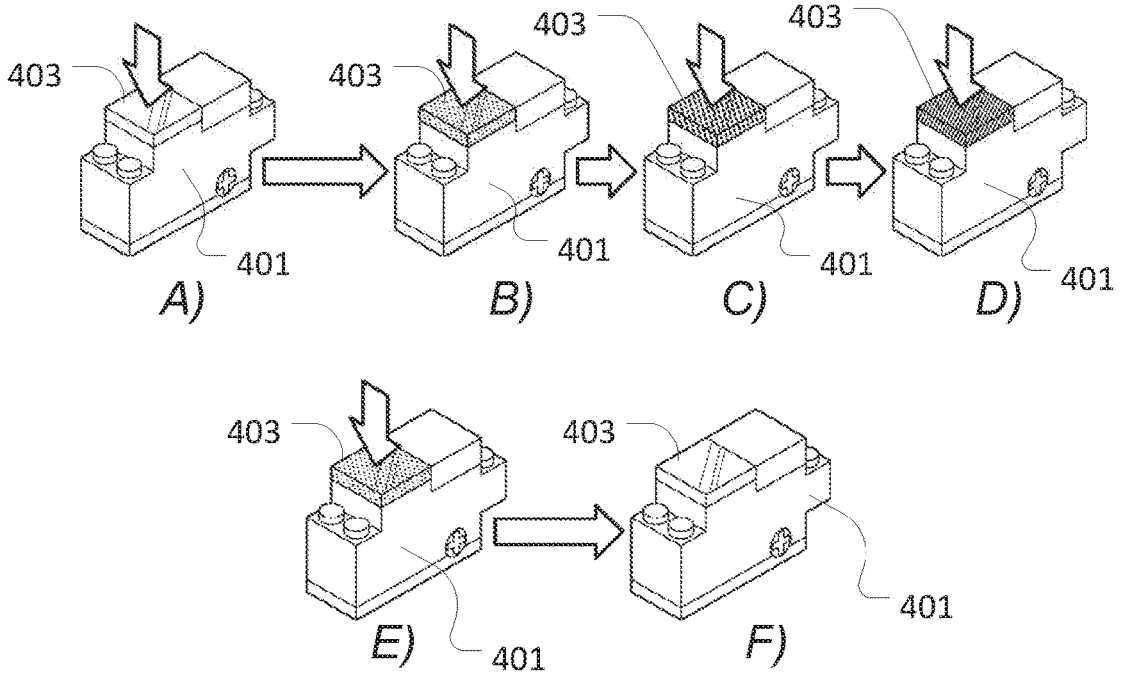

FIG. 9 schematically illustrates operation of an interactive construction element. In the example of FIG. 9, the interactive construction element is a function construction element as described in FIG. 4. It will be appreciated that other function construction elements and input construction elements may be operated in the same manner.

FIG. 9A shows the interactive construction element 401 in a deactivated state. In this state the multi-colored light source integrated in push button 403 is off. Similarly, the transceiver, control circuit and function or sensor element may be powered off or at least brought into an energy conserving state. The interactive construction element is brought into an activated state by pressing the push button 403. Responsive to the activation of the interactive construction element, the control circuit of the multi-coloured is brought into a first one of a plurality of operational modes as indicated by the multi-coloured light source in push button 403 emitting light in a first colour associated with the first operational mode, e.g. red, as illustrated in FIG. 9B. Repeated activation of the push button 403 causes the interactive construction element to repeatedly change operational modes in a cyclic fashion, i.e. each activation of the push button causes the interactive construction element to change to a subsequent mode of a cyclic sequence of modes. Each operational mode has a colour associated with it; accordingly, each activation of the push button causes the multi-coloured light to switch colour to the colour of the newly selected mode, as illustrated by FIGS. 9B-D.

When the push button is activated for an extended period of time, longer than a threshold, e.g. for at least 1 sec. or at least 2 sec, the interactive construction element is deactivated, e.g. powered off or brought into the energy conserving state; accordingly, the multi-coloured light is turned off as well, as illustrated by FIGS. 9E-F.

The selectable operational modes may reflect different behaviour of the interactive construction element such as group membership, a behavioural state such as a mood, a level of sensitivity, etc.

Alternatively or additionally, the push button may be used to control the behaviour of the interactive construction element in one or more of a number of ways, e.g.

ON and OFF (no action/behaviour)

ON and PLAY/STOP simple action

ON and Trigger behaviour (default behaviour or behaviour read from a tag construction element)

ON and change group ID

ON and Mode/Behaviour select

ON and Record (e.g. for a sound construction element)

When activated—in the example of FIG. 9 when changing from the OFF state of FIG. 9A to the activated state of FIG. 9B—the initially selected operational mode may be determined by the control circuit of the interactive construction element in a variety of ways, e.g. at random or always to the same predetermined mode, or by selecting the last operational mode that was active before the element was previously turned off. Alternatively or additional, the selection of the initial mode upon activation may be based on detected other interactive construction elements within the communication range of the interactive construction element. In particular, upon activation of the interactive construction element, the control circuit of the interactive construction element may activate the transceiver of the interactive construction element and detect whether any other interactive construction elements are within the communication range of the interactive construction element. To this end, a number of suitable detection mechanisms may be used. For example, each interactive construction element may, while activated, periodically broadcast identification signals such as identification messages including information such as its operational mode, an element ID and/or a type identifier identifying whether the interactive construction element is a function construction element or an input construction element or even which type of function/control element, i.e. which type of function device or sensor it comprises. Alternatively or additionally, the interactive construction elements may, upon activation, broadcast a request message including the above information and causing other interactive construction elements to respond with a corresponding response message. It will be appreciated that a variety of other recognition mechanisms may be employed allowing interactive construction elements to obtain information about which other interactive construction elements are in its proximity, optionally including information about the current mode settings (e.g. group identifiers), types and/or other operational parameters of the respective other interactive construction elements.

Upon activation, an interactive construction element may thus determine whether one or more other interactive construction elements are present in a predetermined proximity (e.g. within the communication range of the transceiver). If no other interactive construction elements are detected, the interactive construction element may enter a predetermined default operational mode, a randomly selected operational mode or an otherwise selected initial operational mode. If another interactive construction element is detected upon activation of an interactive construction element, the newly activated interactive construction element may automatically enter the same operational mode as the other, detected interactive construction element. If, upon activation of a construction element, multiple other interactive construction elements are detected with different respective modes, the newly activated interactive construction element may select one of the detected operational modes based on a suitable selection mechanism. For example, the newly activated interactive construction element may choose the operational mode of the other interactive construction element that was first detected or that has the highest signal strength, or the operational mode of the majority of the other detected interactive construction elements etc. Other selection rules may include the type of the other interactive construction elements.

Generally, upon activation, an interactive construction element may thus detect one or more other interactive construction elements and perform an arbitration mechanism alone or in cooperation with the other detected interactive construction elements so as to select at least an initial operational mode for the newly activated interactive construction element.

In some embodiments, each operational mode has a group identifier associated with it. Hence, in this embodiment, selection of an operational mode corresponds to the selection of a group identifier. The interactive construction element may thus be associated to each of a number of different groups, each group having a group identifier associated with it which may be represented by a respective colour. By pressing the push button, the user may thus selectively assign each interactive construction element to a group of interactive construction elements. The interactive construction elements of the same group share a common group ID, as may be indicated by a matching colour, which is different from the group IDs (and colours) of other groups. Accordingly, upon activation of an interactive construction element, the interactive construction element may automatically select an initial group ID, e.g. based on group IDs of other detected interactive construction elements.

The assignment of interactive construction elements to respective groups may be used to selectively control the function or behaviour of subsets of function construction elements. To this end, each function construction element may be configured to selectively control its function device responsive to control signals received from input construction elements having the same group ID as the currently selected group ID of the function construction element. The control signals transmitted from input construction elements may thus include the group ID of the input construction element.

Figure 10:
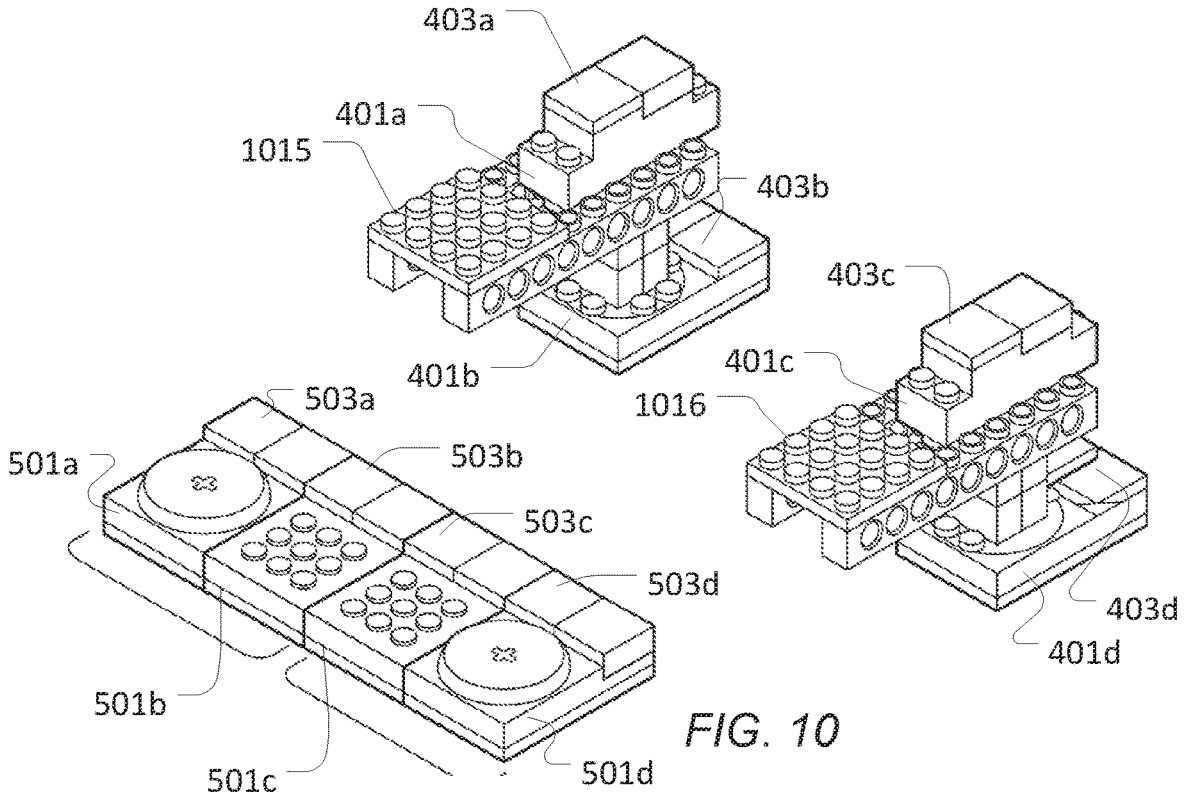
FIG. 10 shows further examples of toy structures constructed from toy construction elements and interactive construction elements as disclosed herein.

This is illustrated in FIG. 10 showing two toy structures 1015 and 1016, respectively, constructed from toy construction elements including multiple function construction elements. Toy structure 1015 is a crane comprising function construction elements 401*a* and 401*b*. Toy structure 1016 is also a crane comprising function construction elements 401*c* and 401*d*. Function construction elements 401*a* and 401*c* each comprise a motor as a function device operable to lower or raise the crane arm of the respective crane. Function construction elements 401*b* and 401*d* each comprise a motor as a function device operable to turn the respective crane around a vertical axis. Function construction elements 401*a* and 401*b* of the crane structure 1015 have been assigned to have the same group identifier corresponding to the "blue" group as indicated by the multi-coloured lights of the push buttons 403*a* and 403*b* of the respective function construction elements. Function construction elements 401*c* and 401*d* of the crane structure 1016 have been assigned to have different group identifiers corresponding to the "yellow" and "green" groups as indicated by their respective multi-coloured lights of the push buttons 403*c* and 403*d* of the respective function construction elements.

The toy construction system further comprise four input construction elements 501*a*-501*d*, each being assigned to a group respective group identifier corresponding to the "blue", blue, "yellow" and "green" group, respectively, as indicated by their respective multi-coloured lights of their respective push buttons 503*a-d*. Hence, function construction elements 401*a* and 401*b* only react on control signals received from input construction elements 501*a* or 501*b*, as only these belong to the same "blue" group. Similarly, function construction elements 401*c* and 401*d* only react on control signals received from input construction element 501*c* and 501*d*, respectively, as only interactive construction elements 401*c* and 501*c* belong to the "yellow" group and only interactive construction elements 401*d* and 501*d* belong to the same "green" group. Hence, by assigning group identifiers to interactive construction elements, a user may selectively control the behaviour of the constructed toy structures.

In the example of FIG. 10, the function construction elements of toy structure 1015 are all set to have a common group ID as indicated by their multi-coloured lights showing the same colour. The function construction elements of toy structure 1016 are set to different group IDs, different from each other and from the group ID of the elements of structure 1015, as indicated by their multi-coloured lights showing another colour. Generally, an input construction element having its current group ID set to the same group ID as the function construction elements of structure 1015 emits a control signal, only the function construction elements of toy structure 1015 react by activating their respective functions, while the function construction elements of toy structure 1016 remain passive.

Figure 11:
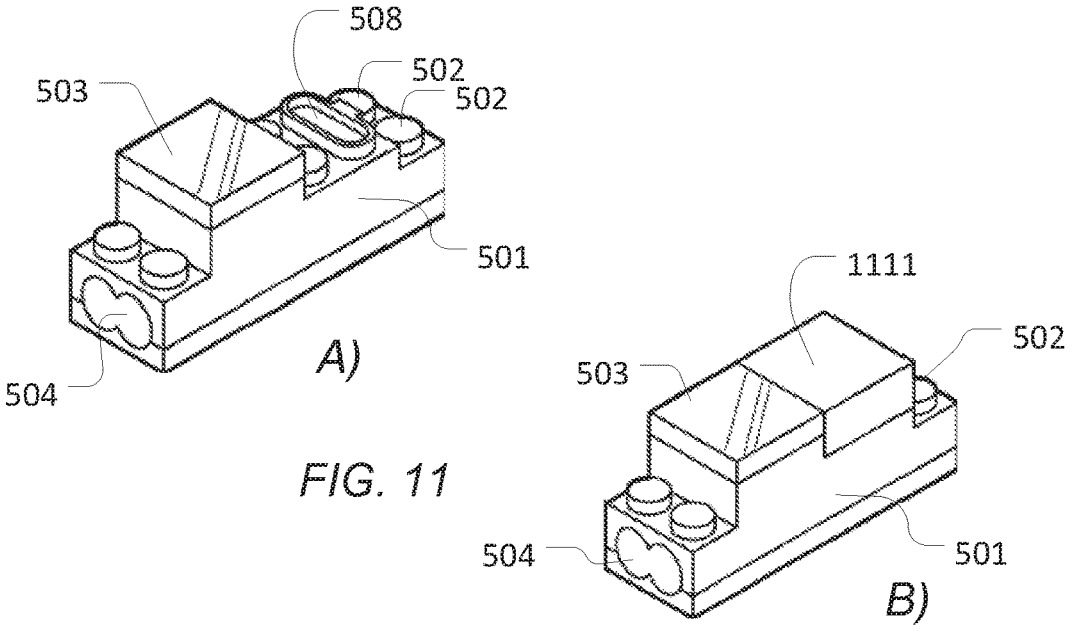
FIGS. 11A-B and 12A-C schematically illustrate the use of tag construction elements in a toy construction system as described herein.

FIGS. 11A-B schematically illustrate the use of tag construction elements in a toy construction system as described herein. In particular, FIG. 11A shows an interactive construction element 501 without a tag construction element while FIG. 11B shows the interactive construction element 501 having a tag construction element 1111 connected to it. In the example of FIG. 11, the interactive construction element is an input construction element as shown in FIG. 5B; it will be appreciated, however, that tag construction elements may be connected to other types of input construction elements or to function construction elements.

The interactive construction element 501 comprises an electrical connector 508 on its top surface to which a tag construction element may be connected. To this end, the tag construction element has a mating connector on its bottom surface. The connector 508 may be configured for data communication between the tag construction element and the interactive construction element. Optionally, the interactive construction element may also provide power to the tag construction element. The tag construction element may comprise a memory having stored thereon a tag identifier and/or other data, e.g. data identifying an operational mode, such as a group identifier, an identifier identifying a behavioural pattern, a sound file, and/or the like.

Hence, when the tag construction element is connected to the interactive construction element, the interactive construction element may read the identifier and/or data from the tag construction element and control operation of the interactive construction element based on the obtained identifier/data. For example, the interactive construction element may enter an operational mode based on the read identifier/data, e.g. set its own group identifier.

It will be appreciated that the electrical connector 508 may also be used to electrically and/or communicatively connect the interactive construction element to other electronic equipment, e.g. to an electrical charger for charging the battery of the interactive construction element or to a computer or other data processing system or device, as described below.

The tag construction element is shaped as a flat plate having coupling members on its bottom surface. The tag construction element of the present example has a shape and size matching the shape and size of the push button 403; it will be appreciated, however that the tag construction element may have different shapes and sizes. Nevertheless, if the tag construction element is shaped and sized such that when connected to one or more coupling members of an interactive construction element, it is large enough to extend across two or more coupling locations of the grid of coupling members, thereby increasing the visibility of the tag construction member in a toy model.

Instead of connecting the tag construction element via an electrically conducting connection, the tag construction element may be configured to exchange data with the interactive construction element in a wireless manner, e.g. by means of near-field communication. To this end the tag construction element may have coupling members allowing the tag construction element to be mechanically attached to the interactive construction element. The interactive construction element may comprise near-field communications reading circuit configured to read an identifier and/or other data from the tag construction element.

Figure 12:
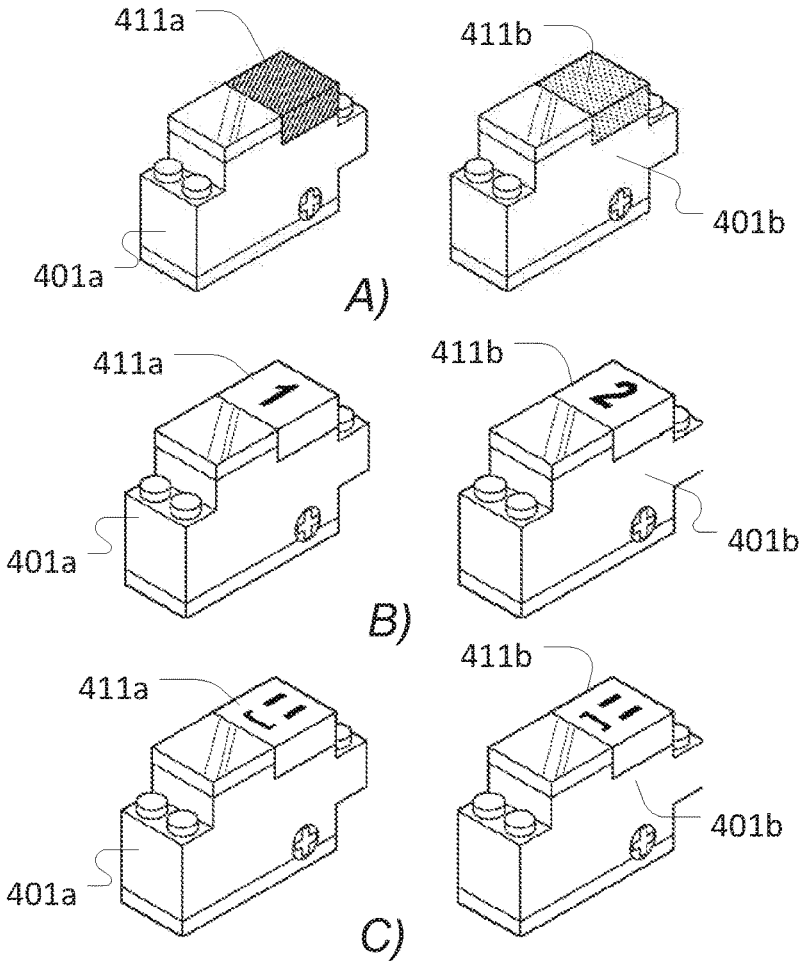

FIG. 12 illustrates different uses of tag construction elements for setting an operational mode of an interactive construction element. In FIG. 12A, the tag construction element has stored thereon a group identifier, and the interactive construction element sets its own group identifier based on the group identifier read from the tag construction element connected to it. In the shown example, function construction element 401*a* has a tag construction element 411*a* attached to it that has a group identifier stored on it identifying the "red" group. Function construction element 401*b* has a tag construction element 411*b* attached to it that has a group identifier stored on it identifying the "blue" group.

In FIG. 12B, the tag construction element comprises an identifier indicative of a role within a group of function construction elements. Consequently a group of function construction elements may each be programmed to perform different behavioural patterns in a group or team of function construction elements. In the shown example, two function construction element elements 401*a* and 401*b* of the same type are shown that both have been assigned to the "blue" group". Function construction element 401*a* has a tag construction element 411*a* attached to it that has a role or group member identifier stored on it identifying the function construction element as group member no. 1. Function construction element 401*b* has a tag construction element 411*b* attached to it that has a group member identifier stored on it identifying the function construction element as group member no. 2. For example, the tags may be programmed by the user. The number may be an indication of tags with a user-defined program/behavior. Alternatively, the number may be used as an extension of a group color/ID so as to allow the system to address a specific member within the group. For example, if the user has constructed a car with two motors, they may be assigned to the same group (e.g. blue) so as to be controlled with the same input construction element, e.g. a tilt sensor in the blue group. However, the user may wish the two motors to react differently on the control signal transmitted by the sensor for the car to be able to turn left and right.

In FIG. 12C, the tag construction element comprises data defining a behavioural pattern or mood, and the function construction element may be configured to control its function device so as to emulate the behavioural pattern identified by the tag construction element connected to it. Examples of behavioural patterns may include angry, happy, sad, tired, "left car wheel", "right car wheel", etc. Such patterns may be expressed by the parameters of the function performed by the function device, e.g. by the volume, pitch or types of sounds played when triggered by receipt of a control signal from an input construction element, by the speed and/or movement pattern of a motor, etc. Function construction element 401*a* has a tag construction element 411*a* attached to it that has an identifier or data stored on it causing the function construction element 401*a* to emulate a "happy" behaviour or mood. Function construction element 401*b* has a tag construction element 411*b* attached to it that has a group member identifier stored on it that has an identifier or data stored on it causing the function construction element 401*a* to emulate a "sad" behaviour or mood.

It will be appreciated that in some of the above uses a simple identifier may suffice to identify the operation state identified by the tag construction element. In other embodiments it may be desirable or even necessary for the tag construction element to store and communicate additional data, such as parameters or even program instructions to be read and used or executed by the interactive construction element. In some embodiments, a tag construction element may have multiple programs stored thereon; each associated with a predetermined set of interactive construction elements. When the tag construction element is connected to a function construction element, the function construction element may detect other interactive construction elements in its proximity and, depending on which interactive construction elements are detected, select a corresponding one of the programs stored on the tag construction element.

At least some of the examples of operational modes may alternatively or additionally be controlled by a user by means of the push button 503 as described above.

Figure 13:
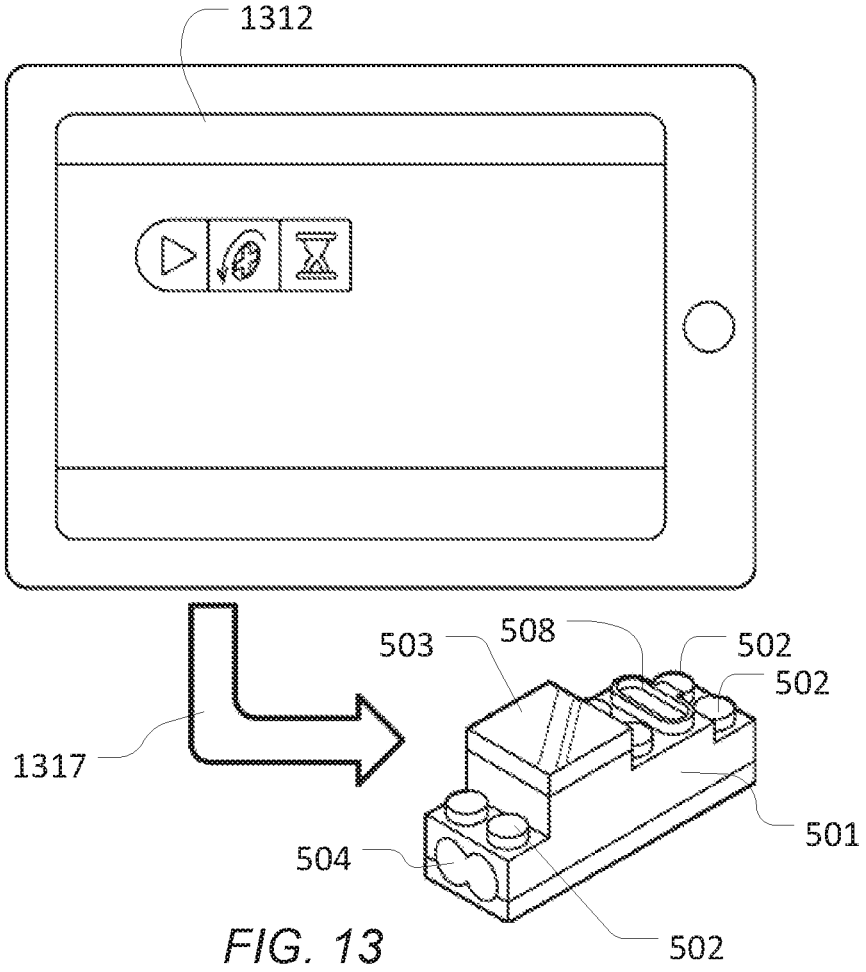
FIG. 13 illustrates a data processing system and an interactive construction element.

FIG. 13 illustrates a toy construction system comprising a data processing system 1312 and an interactive construction element 501. In the example of FIG. 13, the interactive construction element 501 is an input construction element as shown in FIG. 5B; it will be appreciated, however, that tag construction elements may be connected to other types of input construction elements or to function construction elements. The data processing system may be or comprise a suitably programmed computer or other processing device, e.g. a desktop computer, a tablet computer, a smartphone, a laptop computer, or the like. The data processing system 1312 comprises a wireless communications interface 1317 configured to communicate data with an interactive construction element 501. The wireless communication interface may be an integrated communications interface, e.g. a Wifi or Bluetooth interface of a suitably programmed, conventional computer. Alternatively, the wireless communications interface may be a separate communications interface that is connectable to the computer, e.g. via a wired connection, e.g. via a USB port, or wirelessly. Yet alternatively, the interactive construction element 501 may be connectable to the data processing system 1312 via a wire connection e.g. via the electrical connector 508 of the interactive construction element and a suitable I/O port of the data processing system, e.g. a USB port. It will be appreciated that multiple interactive construction elements may be communicatively connected to the data processing system at the same time.

The data processing system 1312 has stored thereon a program, e.g. an App, adapted to interact with one or more interactive construction elements 501. For example, the data processing system 1312 may be configured to provide a programming environment allowing a user to generate, edit programs for controlling the behaviour of one or more interactive construction elements. The generated program may be transferred to and stored on the interactive construction element. Alternatively, the generated program may be stored on a tag construction element. To this end, the system may comprise an interface element that is connectable to a suitable wired or wireless interface of the data processing system and to which a tag construction element may be connected so as to provide a communicative connection between the tag construction element and the data processing system.

Alternatively or additionally, the data processing system 1312 may be configured to emulate an input construction element and transmit control signals for controlling the function of one or more function construction elements.

Yet alternatively or additionally, the data processing system 1312 may be configured to emulate a function construction element and receive control signals from an input construction element and to perform a function responsive to the received control signal. For example, the data processing system may provide a virtual environment in which the behaviour of one or more virtual objects may be controlled or at least influenced by the received control signals.

To this end, the data processing system 1312 may have set a group identifier and/or otherwise emulate an operational mode of an interactive construction element.

Figure 14:
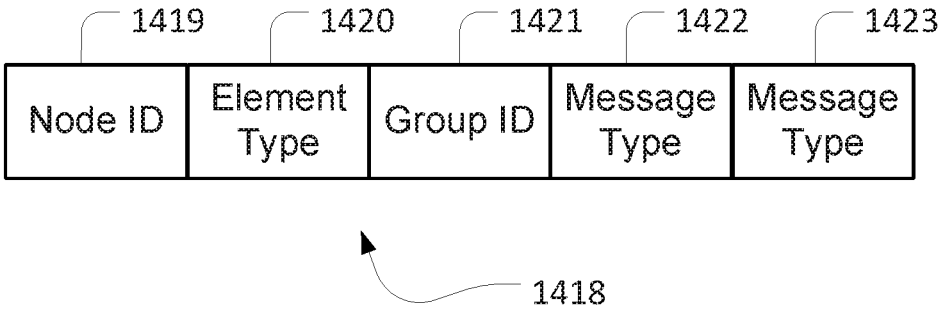
FIG. 14 schematically illustrates an example of a message structure of messages communicated between interactive construction elements as described herein.

FIG. 14 schematically illustrates an example of a message structure of messages communicated between interactive construction elements as described herein. The message 1418 comprises a number of fields, including a node ID 1419 of the sending element, an element type identifier 1420 of the sending element, a group ID 1421 of the sending element, a message type 1422 and a value 1423. The node ID may be an identifier identifying the element among the currently active interactive construction elements within a certain communications range. The element type ID may indicate the type of interactive construction element, e.g. whether the sending interactive construction element is an input construction element or a function element or even which type of input construction element or function construction element, e.g. a motor, tilt sensor, etc. The message type may identify the message as a control message from an input construction element or as an identification message from a function construction element. Other message types may include a request message for requesting other interactive construction elements to send an identification message or a synchronisation message for synchronising a current time in each interactive construction element. It will be appreciated that the message may comprise additional fields such as a header including one or more fields specific to the communications protocol. In some embodiments, messages may only include some of the above fields and/or the number and content of the fields may depend on the message type. In some embodiments, the system may be operable to also communicate other types of messages, e.g. global messages directed to all interactive construction elements regardless their respective group identifiers. In some embodiments, global messages may be indicated by the message type and/or by a default group ID.

Figure 15:
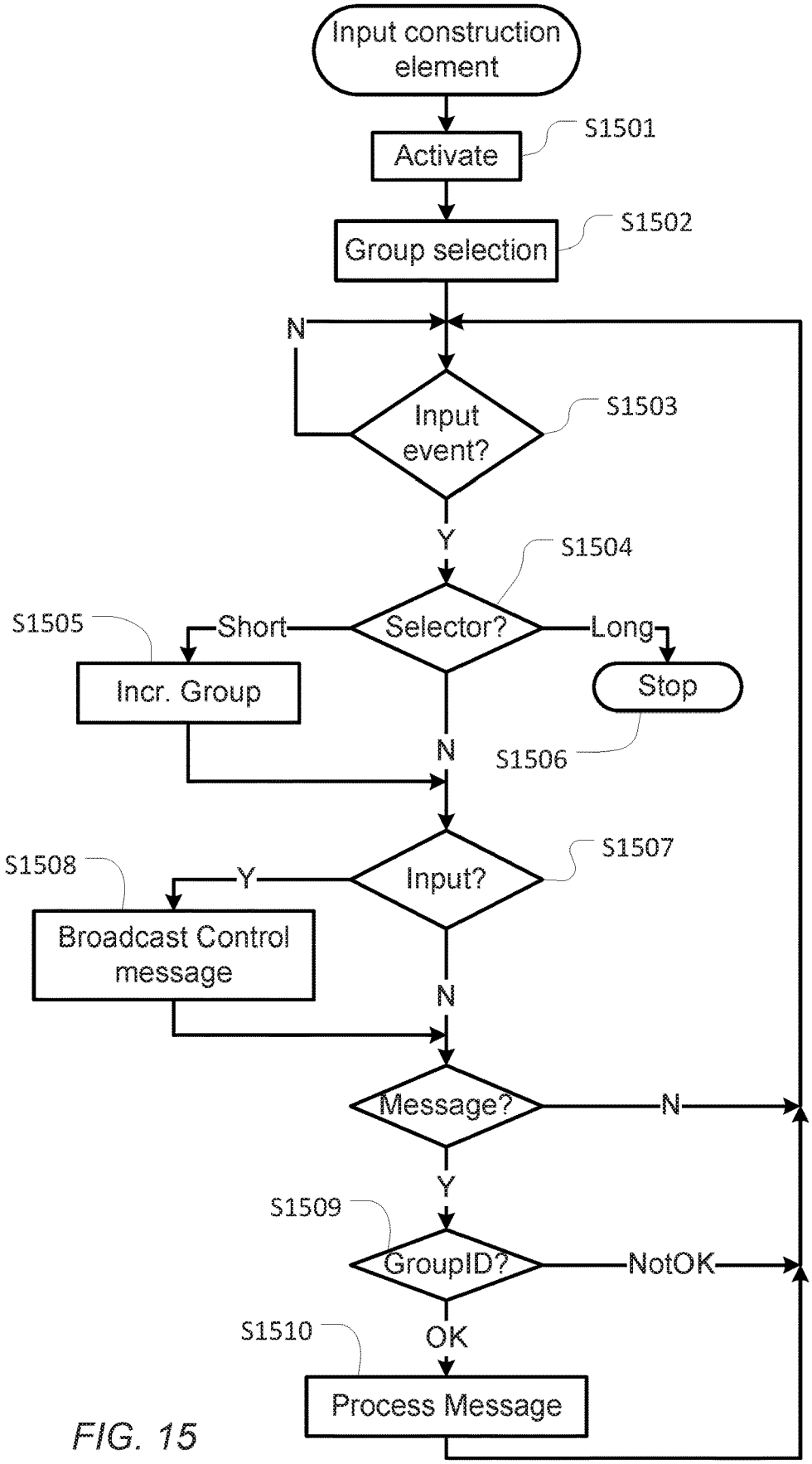
FIG. 15 shows a flow diagram of an example of a process performed by an input construction element

FIG. 15 shows a flow diagram of an example of a process performed by an input construction element, e.g. input construction element 501 of FIG. 5*a*.

In initial step S1501, the input construction element is activated, e.g. by pressing a selector button as described herein.

In subsequent step S1502, the input construction element performs a group selection procedure. To this end, the input construction element may simply select a predetermined default group identifier or set the group identifier to its last value before the input construction element was turned off or entered an energy saving mode last. In another embodiment, the input construction element automatically selects a group identifier based on the group identifiers of other interactive construction elements detectable by the input construction element. For example, the input construction element may broadcast a global message directed to all interactive construction elements and requesting them to return an identification message indicative of at the least the group identifiers of the other interactive construction elements. Upon receipt of one or more such identification messages, the interactive construction element may set its own group identifier based on the received identification message(s). If no identification message is received within a predetermined time-out period, the input construction element sets its group identifier to a default group identifier.

In subsequent step S1503 the input construction element waits for an input event to occur, e.g. for an activation of the element's selector button, a received broadcast message from another interactive construction element or a signal from the sensor or other input device of the input construction element, e.g. a tilt sensor, a microphone, a proximity sensor, a light sensor, etc. An input event from the sensor may e.g. be a change of the sensed quantity detected by the sensor, e.g. a change in angle of a tilt sensor, a change in light intensity measured by a light sensor, etc. Alternatively or additionally, the sensor may continuously or periodically provide a sensor signal regardless of the signal has changed or not.

In subsequent step S1504, the input construction element determines whether its selector button has been pressed. If so, the input construction element increments its group identifier (step S1505) or, if the push button has been pressed for an extended period of time, enters into the deactivated mode (step S1506)

Following step S1504 or step S1505, as the case may be, the process proceeds at step S1507, wherein the input construction element detects an input from its sensor, and the input construction element determines an input value responsive to the received input. For example, the determined input value may be indicative of a tilt angle, a received sound pressure, a received light intensity, a proximity etc.

In subsequent step S1508, the input construction element broadcasts a control message, e.g. a message having a message type "control message". The control message includes the group identifier of the input construction element and the determined input value.

If the input event was a received broadcast message, the process proceeds at step S1509, where the process determines, based on the group identifier and/or the message type of the received message, whether the received message needs to be processed further. If so the process proceeds to step S1510 and processes the received message. For example, if the message was a request to respond with an identification message, the input construction element broadcasts an identification message including its own group ID and, optionally, further information such as the input construction element's node ID, element type, and/or the like. Similarly, if the received message is a time synchronisation message, the input construction element may adjust its internal clock based on the received time information.

Finally, the process returns to step S1503 to wait for the next input event.

Figure 16:
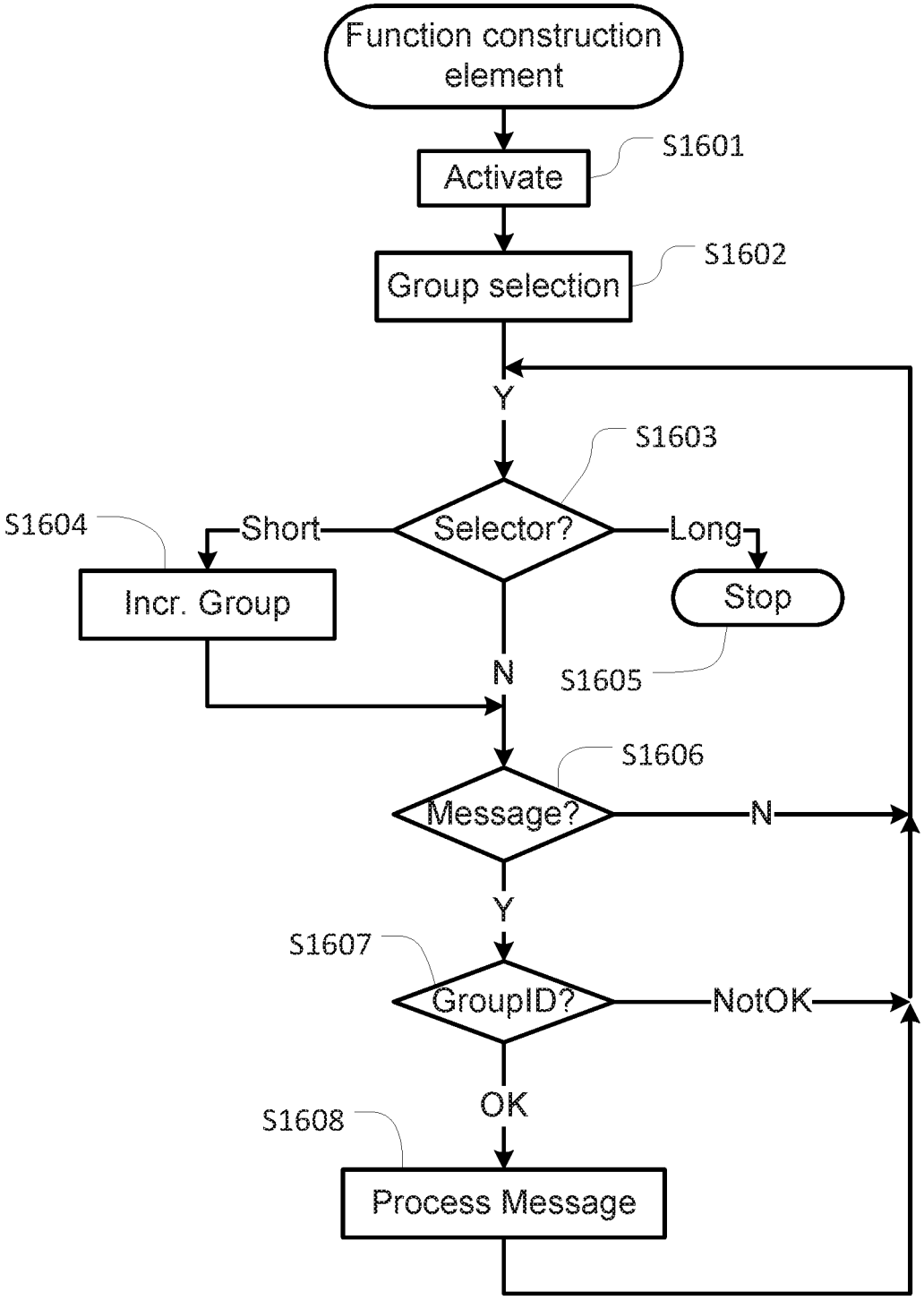
FIG. 16 shows a flow diagram of an example of a process performed by a function construction element

FIG. 16 shows a flow diagram of an example of a process performed by a function construction element, e.g. function construction element 401 of FIG. 4*a*.

In initial step S1601, the function construction element is activated, e.g. by pressing a selector button as described herein.

In subsequent step S1602, the function construction element performs a group selection procedure, e.g. as described in connection with corresponding step S1502 above.

In subsequent step S1603, the function construction element determines whether its selector button has been pressed. If so, the input construction element increments its group identifier (step S1604) or, if the push button has been pressed for an extended period of time, enters into the deactivated mode (step S1605).

Following step S1603 or step S1604, as the case may be, the process proceeds at step S1606, wherein the function construction element determines whether it has received a broadcast message from another interactive construction element. If so, the process proceeds at step S1607 where the function construction element determines whether the received message has a group identifier equal to the group identifier of the function construction element or a group identifier (or message type) indicating the message as a global message directed towards all interactive construction elements. If this is the case, the process proceeds at step S1608 where the process determines the message type of the received message and processes the message accordingly. For example, if the received message is a control message, the function construction element reads the value included in the message and performs a function responsive to the received message. For example, if the function element is a motor, the function element may start or stop the motor and/or adjust the speed or direction of movement of the motor responsive to the received value. To this end, the function construction element may execute an executable program with the received value as an input parameter. In some embodiments, the function construction element may perform the function responsive to additional or alternative parameters received as part of the message, e.g. the element type ID or even the node ID included in the message. The executable program may be stored in a memory of the function construction element or a tag construction element connected to the function construction element.

If the received message was an identification message, the function construction element may update a list of known other interactive construction elements within a proximity of the function construction element. Additionally or alternatively, the function construction element may select one of a number of executable programs responsive to the received identification message so as to select the behaviour of the function construction element. The selected program may be executed automatically and/or responsive to a received control message as described above.

If the received message was a request to respond with an identification message, the function construction element broadcasts an identification message including its own group ID and, optionally, further information such as the function construction element's node ID, element type, and/or the like. Similarly, if the received message is a time synchronisation message, the function construction element may adjust its internal clock based on the received time information.

Embodiments of the control circuits of the construction elements described herein can be implemented by means of hardware comprising several distinct elements, and/or at least in part by means of a suitably programmed microprocessor.

In the claims enumerating several means, several of these means can be embodied by one and the same element, component or item of hardware. The mere fact that certain measures are recited in mutually different dependent claims or described in different embodiments does not indicate that a combination of these measures cannot be used to advantage.

It should be emphasized that the term "comprises/comprising" when used in this specification is taken to specify the presence of stated features, elements, steps or components but does not preclude the presence or addition of one or more other features, elements, steps, components or groups thereof.

The invention claimed is:

1. A toy construction system comprising:

a plurality of toy construction elements for the construction of an interactive toy construction model, wherein each of the plurality of toy construction elements comprises coupling members configured for releasably interconnecting the plurality of toy construction elements with each other so as to form a toy construction model, the plurality of toy construction elements comprising:

a plurality of function construction elements, wherein each function construction element comprises:

a function device adapted to perform a controllable user-perceptible output function;

an internal control circuit to control the function device; and a transceiver in communication with the internal control circuit and operable for radiofrequency communication with other function construction elements of the plurality of function construction elements; and a tag construction element mechanically connectable to a first function construction element of the plurality of function construction elements, the tag construction element configured for wireless data communication with the first function construction element;

wherein:

the transceiver is configured to receive a control signal from other function construction elements of the plurality of function construction elements, and the internal control circuit, responsive to the control signal and to data received from the tag construction element, controls operation of the function device of the first function construction element to perform the controllable user-perceptible output function.

2. The toy construction system according to claim 1, wherein the tag construction element is configured for data communication with the first function construction element when the tag construction element is mechanically connected to the first function construction element.

3. The toy construction system according to claim 1, wherein the first function construction element is configured to control the function device responsive to data received from the tag construction element only when the tag construction element is connected to the first function construction element.

4. The toy construction system according to claim 1, wherein the received data comprises an identifier causing the first function construction element to control the function device responsive to the received identifier.

5. The toy construction system according to claim 1, wherein the tag construction element comprises a memory for storing data and the data is selected from one or more of a tag identifier, data identifying an operational mode, an identifier identifying a behavioral pattern, and a sound file.

6. The toy construction system according to claim 1, wherein each function construction element comprises a wireless communications interface for communicating with one or more other ones of the function construction elements.

7. The toy construction system according to claim 1, wherein the first function construction element is configured to detect a type and/or identity of one or more other of the plurality of function construction elements in a proximity of the first function construction element; and to control the function device of said first function construction element responsive to the detected type and/or identity.

8. The toy construction system according to claim 1, wherein each of the plurality of function construction elements has a top surface, a bottom surface, and at least one side surface, wherein said coupling members are placed on at least one of the top and the bottom surface.

9. The toy construction system according to claim 1, wherein the coupling members are arranged in one or more regular planar grid defining the direction of connection.

10. The toy construction system according to claim 1, wherein the tag construction element comprises coupling member corresponding to the coupling members of the plurality of function construction elements.

11. The toy construction system according claim 10, wherein the tag construction element is shaped as a plate having coupling members on its bottom surface.

12. The toy construction system according to claim 1, further comprising one or more input construction elements, each of said input construction elements comprising an input device operable to receive an input and configured to transmit, responsive to the received input, a control signal to at least a subset of the plurality of function construction elements.

13. The toy construction system according to claim 12, wherein the input device comprises a sensor responsive to a predetermined sensor input; the input construction element being adapted, in response to the predetermined sensor input, to output a control signal corresponding to the predetermined sensor input.

14. The toy construction system according to claim 12, comprising a plurality of input construction elements responsive to different predetermined sensor inputs.

15. The toy construction system according to claim 14, wherein each said predetermined sensor input is chosen from one or more of a mechanical force, a push action, a tilt orientation, a pull action, a rotation, a human manipulation, a touch, a proximity of an object, an electrical signal, a radio frequency signal, an optical signal, a visible light signal, an infrared signal, a magnetic signal, a temperature, a humidity, and a radiation.

16. The toy construction system according to claim 1, further comprising a plurality of function construction elements whose function devices are adapted to perform different functions.

17. The toy construction system according to claim 1, wherein the first function construction element is configured to provide power to the tag construction element.

18. A toy construction system comprising:

a function construction element including:

a control circuit; and a transceiver in communication with the control circuit and operable for radiofrequency communication with other function construction elements, the transceiver configured to receive a control signal from other function construction elements;

a function device adapted to perform a user-perceptible output function; and a tag construction element mechanically connectable to the function construction element, the tag construction element configured to automatically and wirelessly communicate data to the function construction element upon connection thereto, wherein the control circuit is configured to control operation of the function device of the function construction element responsive to the data and responsive to the control signal.

19. The toy construction system according to claim 18, wherein the data is selected from the group consisting of: an identifier including an identifier indicative of a role within a group of function construction elements, a group identifier, a role identifier, a user-defined program, a behavioral pattern, a mood, and an operational mode.

20. A toy construction system comprising:

a first and second function construction element for the construction of an interactive toy model, each of the first and second function construction elements comprising:

coupling members configured for releasably interconnecting the first and second toy construction elements with each other so as to form a toy construction model;

a function device adapted to perform a controllable user-perceptible output function;

an internal control circuit to control the function device; and a transceiver in communication with the internal control circuit and operable for radiofrequency communication with other function construction elements of the first and second function construction elements; and a tag construction element mechanically connectable to the coupling members of the first function construction element and configured for data communication between the tag construction element and the internal control circuit of the first function construction element;

wherein:

the first function construction element includes a user-operable input device and is configured to generate a control signal based on the actuation of the user-operable input device and the tag construction element, the transceiver of the second function construction element is configured to receive the control signal from the first function construction element, and the internal control circuit of the second function construction element, responsive to the control signal of the first function construction element, controls operation of the function device of the second function construction element to perform the controllable user-perceptible output function.

* * * * *